United States Patent [19]

Nevalainen

[11] 4,249,961

[45] Feb. 10, 1981

[54] HIGH STRENGTH STEEL FOR DIFFUSION CHROMIZING

[76] Inventor: Harri Nevalainen, Terästehdas B 88/A8, 55610 Imatra 61, Finland, 55610

[21] Appl. No.: 922,220

[22] Filed: Jul. 5, 1978

Related U.S. Application Data

[62] Division of Ser. No. 763,130, Jan. 27, 1977, abandoned.

[30] Foreign Application Priority Data

Mar. 6, 1976 [GB] United Kingdom ..... 9082/76

[51] Int. Cl.[3] ..... C21D 1/48

[52] U.S. Cl. ..... 148/14; 148/31.5; 148/36; 427/253

[58] Field of Search ..... 75/124, 126 D, 126 E, 75/126 F, 126 C; 148/36, 14, 31.5; 428/667; 427/253

[56] References Cited

U.S. PATENT DOCUMENTS

| | | | |
|---|---|---|---|
| 2,157,594 | 5/1939 | Cooper | 148/14 |
| 2,572,191 | 10/1951 | Payson | 75/126 F |
| 3,044,872 | 7/1962 | Hayes | 75/126 F |
| 3,353,936 | 11/1967 | Samuel et al. | 428/667 |
| 3,899,368 | 8/1975 | Waid et al. | 148/36 |

FOREIGN PATENT DOCUMENTS

| | | | |
|---|---|---|---|
| 1070158 | 5/1967 | United Kingdom | 428/667 |
| 1200423 | 7/1970 | United Kingdom | 75/126 D |

OTHER PUBLICATIONS

Steel Products Manual, Stainless and Heat Resisting Steels, 12/74, p. 20.

*Primary Examiner*—L. Dewayne Rutledge
*Assistant Examiner*—John P. Sheehan
*Attorney, Agent, or Firm*—Wigman & Cohen

[57] ABSTRACT

A high strength steel especially suitable for diffusion chromizing and a method for making same is described. The high strength steel comprises a carbon content of 0.01 to 0.08%, 0.1 to 1.0% silicon, 0.5 to 2.2% manganese, 2.0 to 10% chromium, 0.01 to 0.4% molybdenum, 0.002 to 0.05% aluminum, up to 1% of a carbide former and iron with normal impurities. The low carbon steel is heated at an elevated temperature (e.g., 1100° C.) in the presence of chromium to effect diffusion of the chromium into the steel surface whereby a diffusion layer with a high concentration of chromium is formed.

9 Claims, 3 Drawing Figures

Experimental data on α/γ phase boundary in Fe-Cr binary system. Numbers correspond to Cr-atom-% and numbers in brackets correspond to Cr % in wt.

Experimental data on α/γ phase boundary in Fe-Cr binary system. Numbers correspond to Cr-atom-% and numbers in brackets correspond to Cr % in wt.

HIGH STRENGTH STEEL FOR DIFFUSION CHROMIZING

This is a division of application Ser. No. 763,130 filed Jan. 27, 1977, now abandoned.

BACKGROUND OF THE INVENTION

The present invention relates to a high strength steel especially suitable for diffusion chromizing having as quenched mechanical properties corresponding to those of quenched and tempered machine construction steels. In order to increase the lifetime of machine parts against corrosion, many different methods are in use to coat parts with a protective layer. One such method is diffusion chromizing.

The diffusion chromizing is accomplished by holding the part to be coated above the temperature of 900° C. in an atmosphere providing chromium atoms, e.g. some chromium halogenide, usually chromium chloride ($CrCl_2$). Chromium chloride transfers its chromium atom to the surface of the part to be chromized and receives an iron atom from the surface in the so-called exchange reaction.

A chromium rich zone is thus produced at the surface of the iron, from which chromium diffuses inwards. The chromium potential of the atmosphere is usually between 40–60%. An $\alpha$-ferrite zone is then formed at the surface of the part. The thickness of that zone increases at the same rate as chromium diffuses inwards and its content exceeds about 11% (at 1100° C.). This can be seen from the Fe-Cr-phase diagram represented in FIG. 1, where isotherm (1) corresponding to the temperature of 1100° C. is drawn. The curved lines (2, 3) are the calculated phase boundaries of $\gamma$- and $\alpha$-phases.

The formation of $\alpha$-ferrite starts, when the chromium content exceeds the value corresponding to the intersection of the isotherm and the $\gamma-(\gamma+\alpha)$ phase boundary being this value at 1100° C. about 11%. The microstructure is totally $\alpha$-ferritic at all temperatures when the chromium content exceeds 13.2%. The thickness of the diffusion chromized zone usually means that part of the zone which contains at least 12% chromium. In this application the zone thickness means that part of the metal that has transformed to $\alpha$-ferrite during chromizing. Hence no separate layer is formed on the surface of the part like in electrolytic surface treatments or in molten metal dipping treatments, but the protective zone forms in the metal itself by chromium diffusion from the surface inwards.

Some prior art steels are known aimed for diffusion chromizing (DT 2155439, DT 1159238, SW 346817, US 3,717,444). These steels are usually low-carbon grades alloyed either with strong carbide formers alone (Ti, Zr, Nb, Ta) and having thus low hardenability or they have been alloyed with austenite stabilizing elements like manganese (Mn) (DT 2155439, SW 346817) or nickel (Ni) (US 3,717,444) in order to improve their hardenability. In the composition of these steels it has not, however, been taken into consideration the dependence of the chromizing time on the composition. The diffusion chromizing time varies normally from 4 to 12 hours depending on the zone thickness desired and on the composition of the steel. For economic reasons it is thus important to shorten the treating time. The composition of the steel of the present invention is determined having that objective in mind.

SUMMARY OF THE INVENTION

To enlighten the significance of the composition, results will be examined, which have been achieved in experiments undertaken for development of the steel of the present invention.

The growth rate of the diffusion zone depends on the following circumstances: chromium potential of the chromium agent, diffusion rate of chromium in ferrite, chromium content of the steel and chromium content corresponding to the austenite-ferrite phase transformation. The most important requirement for a steel aimed for diffusion chromizing is a very low carbon content. The formation of a carbide barrier under the surface, hindering the chromium diffusion, is therefore avoided. The low carbon content can be attained either by lowering the carbon in the oxidizing stage of steelmaking process to a sufficient low level or by stabilizing free carbon with carbide formers.

In order to attain good mechanical properties the hardenability of the steel must be adequate, i.e. the steel must be properly alloyed.

The novelty of the steel of the present invention relates to the combination of alloying elements which have been used to obtain the hardenability for the steel. The steel has been alloyed mainly with a ferrite stabilizing element chromium (Cr), which results in the fact that the diffusion chromizing time to attain a certain coating thickness is remarkably shorter than with steels alloyed with austenite stabilizing elements like manganese or nickel.

In preparing the chemical composition of the steel of the present invention, it has been utilised the idea appearing in our experiments that the transfer rate of the ferrite-austenite phase boundary which can be considered equal to the growing rate of the diffusion zone thickness depends on the chromium content of the steel and on the relative stability of austenite in comparison to the ferrite at diffusion chromizing temperature.

Manganese and nickel widen the austenite stability range and raise accordingly the chromium content corresponding the the austenite-ferrite phase transformation. Because the diffusion rate of chromium in austenite is significantly smaller than in ferrite, the austenite stabilizing elements tend to retard the progress of the phase boundary and hence the growth of the diffusion zone compared to unalloyed steels. Correspondingly, chromium content of the steel decreases that amount of chromium which has to be diffused into the austenite before the austenite-ferrite phase transformation can take place, thus increasing the growth rate of the diffusion compared to an unalloyed steel.

DESCRIPTION OF THE PREFERRED EMBODIMENT

The validity of the idea of the effect of alloying on the diffusion zone growth rate has been investigated mathematically, by making use of the known diffusion equations, diffusion rate coefficients and phase diagrams. The results obtained by calculations have been confirmed by diffusion chromizing experiments carried out on differently alloyed steel specimens. The calculated and experimental results are presented in FIG. 2 of the drawings. On the vertical scale is given the time in hours (h) needed to obtain a 100 $\mu$m thick diffusion zone at the temperature of 1100° C. and with the chromium potential of 40% Cr. On the horizontal scale is the content of the main alloying element in the steel (Cr, Mn or Ni).

Figure 2:
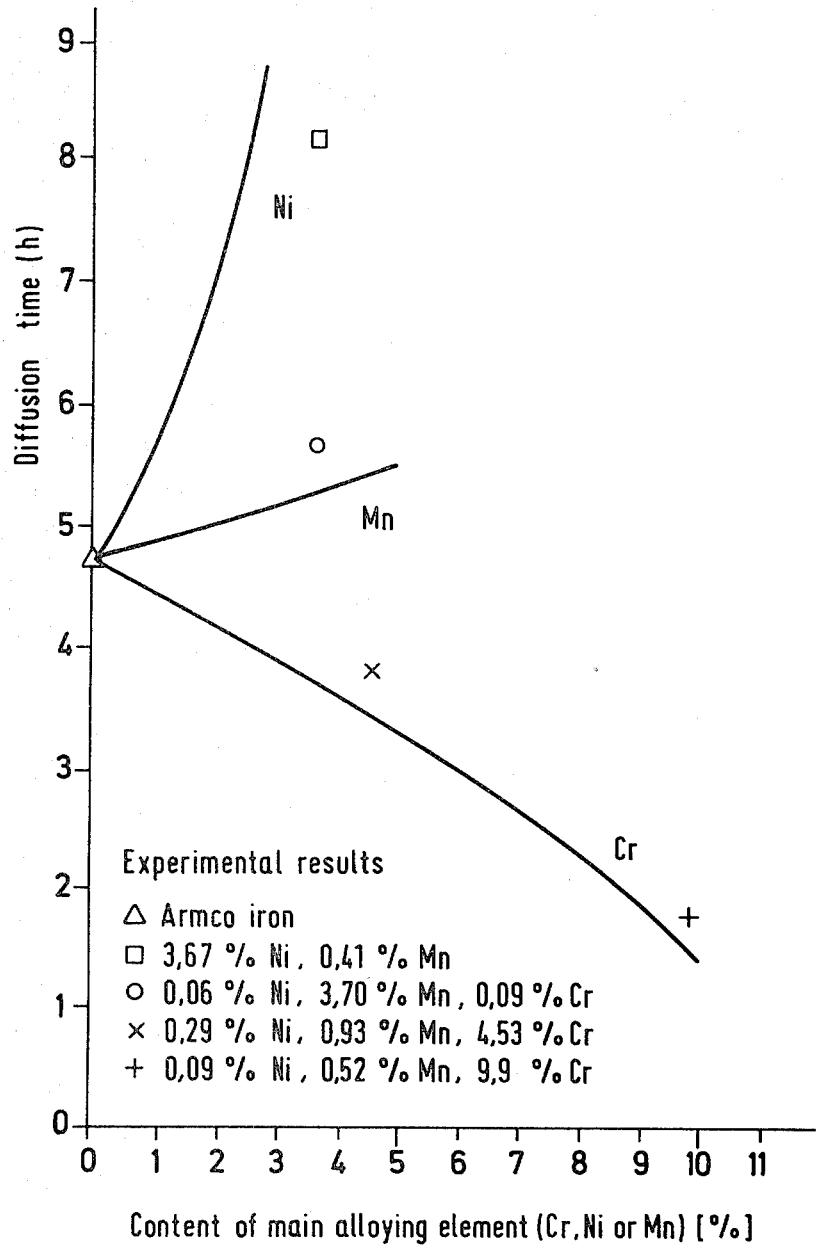

The curves shown in FIG. 2 indicate the calculated effects of nickel, manganese and chromium on the chromizing time so that the curve labelled with Ni indicates the effect of nickel and the curve labelled with Mn indicates the effect of manganese and the curve labelled with Cr that of chromium. The experimental results obtained with differently alloyed steel specimens are reduced to correspond diffusion zone thickness of 100 μm and are presented in the same figure.

The carbon content of all steel specimens was about 0.05% C and the niobium content about 0.08% Nb. The amounts of other alloying elements are indicated in FIG. 2. The calculated and experimental results have a fair correlation. Calculations reveal that manganese increases the chromizing time by about 2 to 3% and nickel increases by about 19% per one percent by weight of alloying element, but chromium decreases the chromizing time by about 6% per one percent by weight of alloying element. These calculations consider chromizing of a 100 μm thick diffusion zone at the temperature of 1100° C. and with the chromium potential of 40% Cr. Thus a steel containing, e.g. 2% nickel, has a calculated chromizing time 95% longer than 4% chromium containing steel.

The time saving is of great significance because the chromizing times are rather long as was stated before.

The chemical composition of the steel well suitable for diffusion chromizing is according to the present invention as follows:

| | | | |
|---|---|---|---|
| carbon | 0.01–0.08%, | preferably | 0.01–0.05% |
| silicon | 0.1–1.0% | | |
| manganese | 0.5–2.2%, | preferably | 0.5–1.0% |
| chromium | 2.0–10.0%, | preferably | 4.0–8.0% |
| molybdenum | 0.01–0.4% | | |
| aluminium (metallic) | 0.002–0.05% | | |
| Alternatively: | | | |
| Ti, Zr, Ta, Nb | 0.10–1.00% | total of one or more of these elements combined | |

The balance apart from incidental impurities being iron. The amount of residual elements and impurities corresponds to the requirements set up for high quality machine construction steels. The lower limit of the carbon content is determined by sufficient hardness of the martensite and by the diffusion chromizing and corrosion properties. The effect of chromium on the chromizing time is small on the lower limit (2%). On the upper limit (10%) the steel has a high hardenability and superior diffusion chromizing and corrosion properties.

Figure 1:
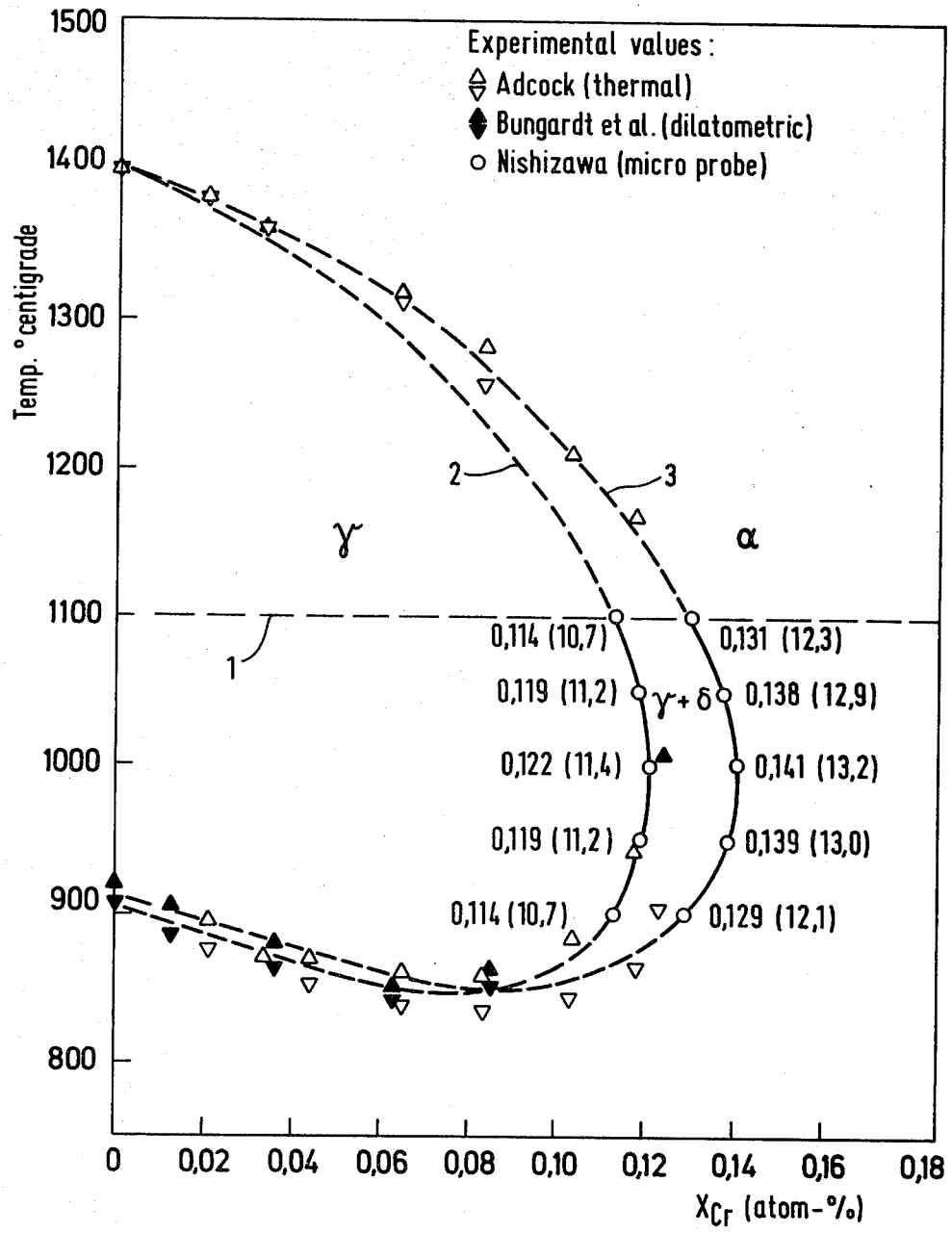

The corrosion resistance especially in cases, when the chromized surface may get scratched is better the higher the chromium content of the base material. However, the hardening temperature will increase drastically if the chromium content exceeds about 10%, as can be seen from FIG. 1. Particularly preferable is the chromium content range from 4.0% to 8.0%. This range results in a good hardenability and growth rate of the diffusion zone and the hardening temperature is low. However, the hardenability is not too high to prevent getting a favourable soft microstructure by, e.g. cold forming by a suitable cooling.

In the following are presented results of diffusion chromizing experiments that have been carried out on steels of the present invention. The chemical analyses of the steels used are presented in Table 1.

TABLE 1.

The analyses of the experimental steels in wt-%.

| Steel | C | Si | Mn | Cr | Ni | Mo | Cu | V | Ti | No | Zr | $Al_{sol.}$ |
|---|---|---|---|---|---|---|---|---|---|---|---|---|
| A | 0.016 | 0.00 | 0.00 | 0.01 | 0.00 | 0.00 | 0.05 | 0.00 | 0.00 | 0.00 | 0.00 | 0.010 |
| B | 0.052 | 0.27 | 0.67 | 4.05 | 0.18 | 0.04 | 0.19 | 0.01 | 0.01 | 0.227 | 0.00 | 0.030 |
| C | 0.060 | 0.25 | 0.93 | 4.53 | 0.29 | 0.04 | 0.17 | 0.01 | 0.01 | 0.10 | 0.00 | 0.016 |
| D | 0.040 | 0.17 | 0.79 | 4.02 | 0.14 | 0.02 | 0.15 | 0.00 | 0.01 | 0.11 | 0.00 | 0.010 |
| E | 0.070 | 0.26 | 0.64 | 6.4 | 0.08 | 0.02 | 0.03 | 0.02 | 0.01 | 0.10 | 0.00 | 0.002 |
| F | 0.050 | 0.19 | 1.28 | 7.9 | 0.08 | 0.20 | 0.03 | 0.02 | 0.01 | 0.03 | 0.16 | 0.002 |
| G | 0.050 | 0.79 | 1.24 | 3.3 | 0.08 | 0.04 | 0.03 | 0.02 | 0.01 | 0.20 | 0.00 | 0.003 |
| H | 0.031 | 0.34 | 0.87 | 5.5 | 0.08 | 0.33 | 0.03 | 0.02 | 0.01 | 0.55 | 0.17 | 0.004 |
| I | 0.060 | 0.13 | 0.52 | 9.9 | 0.09 | 0.04 | 0.03 | 0.03 | 0.01 | 0.10 | 0.00 | 0.009 |
| J | 0.051 | 0.53 | 1.88 | 3.9 | 0.16 | 0.05 | 0.21 | 0.03 | 0.10 | 0.09 | 0.00 | 0.004 |
| K | 0.073 | 0.32 | 0.95 | 7.2 | 0.18 | 0.04 | 0.20 | 0.03 | 0.18 | 0.31 | 0.00 | 0.008 |

Steel A is Armco iron used for comparison. Diffusion chromizing experiments have been carried out with powder pack method on steels A, B and C and with carrier gas method on steels C–K. In the powder pack method the parts to be chromized are packed in chromizing powder. The composition of the powder used was as follows:

50% Cr-powder (grain size 60 mesh)
45% $Al_2O_3$-powder
5% $NH_4Cl_2$

The chromizing temperature was 1100° C. In the carrier gas method the specimen to be chromized and chromium powder were placed in a tube furnace, which was heated to a temperature of 1100° C. Hydrogen saturated with hydrochloric acid was led through the furnace in such a way that the gas mixture first passed over the chromium powder and then over the specimen. The reaction of hydrochloric gas with chromium powder produces chromous chloride which gives up its chromium atom to the surface of the steel specimen via the exchange reaction. Results of these diffusion chromizing experiments are presented in Tables 2–3.

TABLE 2.

Results of the diffusion chromizing experiments with powder pack method.

| Steel | Zone thickness, μm | Time,h |
|---|---|---|
| A | 75 | 4 |
| A | 176 | 12 |
| B | 83 | 4 |
| B | 161 | 8 |
| B | 208 | 12 |
| C | 86 | 4 |
| C | 146 | 8 |
| C | 195 | 12 |

TABLE 3.

Results of the diffusion chromizing experiments with carrier gas method (1000° C., 5 h).

| Steel | C | D | E | F | G | H | I | J | K |
|---|---|---|---|---|---|---|---|---|---|
| Zone thickness (μm) | 115 | 110 | 130 | 145 | 110 | 125 | 170 | 110 | 135 |

Figure 3:
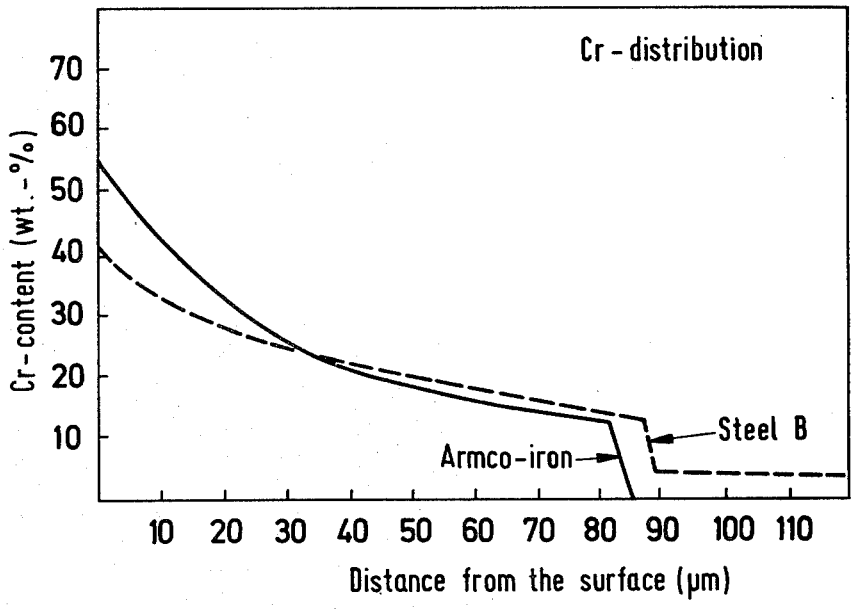

Results show that the growth rate in the steel of the invention is faster than that in the comparison steel A. FIG. 3 shows two chromium distribution curves in diffusion zones obtained in chromizing experiments. According to the measurements the chromium content on the surface varies between 40 and 60%.

In Table 4 are presented the results of the tensile tests of specimen which are diffusion chromized with powder pack method (steels B and C):

TABLE 4.

Results of the tensile and hardness tests carried out with diffusion chromized specimen (powder pack method).

| Steel/ chromizing time, h | Yield strength, MPa | Tensile strength, MPa | Elongation of rupture, % | Contraction % | Hardness HV 10 |
|---|---|---|---|---|---|
| B/4 | 560 | 760 | 14.8 | 65.8 | 253(385) |
| C/4 | 610 | 880 | 14.6 | 65.9 | 302(367) |
| B/12 | 510 | 660 | 18.0 | 68.6 | 239 |
| C/12 | 590 | 740 | 16.0 | 74.0 | 258(376) |

The mechanical properties are for tensile test specimens which have been cooled in the chromizing box for ½ hour from 1100° C. to near room temperature. The hardness values shown in parenthesis are for test specimens quenched in water. Chromized surfaces were faultless after quenching. The water quenched condition is the best one for the steel of the invention.

In Table 5 are presented the results of the tensile tests of the steels E–K after simulated chromizing and tempering for 1 hour at 450° C. The simulation is carried out by annealing the specimen for 5 hours at 1100° C. in oxygen free atmosphere and cooling in air.

In Table 6 are the results of the tensile tests of steels C–K after simulated diffusion chromizing and austenitising for ½ hour at 920° C., water quenching and tempering (1 h) if indicated.

TABLE 5.

Results of the tensile and hardness tests after simulated chromizing (1100° C., 5 h) and cooling in air plus tempering (450° C., 1 h).

| Steel | Yield strength, MPa | Tensile strength, MPa | Elongation of rupture % | Contraction % |
|---|---|---|---|---|
| E | 903 | 981 | 14.9 | 65.8 |
| F | 1005 | 1084 | 13.7 | 66.5 |
| G | 814 | 952 | 15.9 | 64.5 |
| H | 667 | 716 | 15.3 | 64.3 |
| I | 1020 | 1168 | 16.6 | 59.8 |
| J | 957 | 1104 | 15.3 | 62.7 |
| K | 1025 | 1153 | 14.2 | 61.8 |

TABLE 6.

Results of the tensile tests after simulated chromizing (1100° C., 5 h) and cooling in air plus austenitising (920° C., ½h), water quenching plus tempering (1 h) if indicated.

| Steel | Tempering °C. | Yield strength, MPa | Tensile strength, MPa | Elongation of rupture % | Contraction % |
|---|---|---|---|---|---|
| C | none | 820 | 995 | 12.0 | 67.5 |
| C | 500 | 855 | 990 | 14.8 | 70.5 |
| D | none | 815 | 1030 | 14.6 | 74.3 |
| D | 450 | 885 | 1000 | 16.0 | 75.8 |
| E | none | 947 | 971 | 13.4 | 70.0 |
| E | 450 | 839 | 952 | 16.5 | 65.5 |
| F | none | 1005 | 1040 | 14.5 | 66.5 |
| F | 450 | 873 | 1025 | 15.8 | 65.8 |
| G | none | 1001 | 1060 | 13.0 | 67.8 |
| G | 450 | 883 | 1020 | 17.4 | 68.5 |
| H | none | 628 | 662 | 15.7 | 68.8 |
| H | 450 | 569 | 647 | 17.0 | 71.2 |
| I | none | 972 | 1143 | 11.5 | 56.5 |
| I | 450 | 957 | 1118 | 17.0 | 65.5 |
| J | none | 1065 | 1109 | 13.6 | 65.7 |
| J | 450 | 971 | 1089 | 16.3 | 67.0 |
| K | none | 972 | 1109 | 12.2 | 61.8 |
| K | 450 | 961 | 1089 | 14.7 | 72.5 |

The experimental results show that a steel according to this invention is very well suited for different kinds of diffusion chromizing. When the same zone thickness is aimed, the chromizing time is shorter than with Armco iron used as a comparison and considerably shorter than with steels alloyed mainly with manganese or nickel. The powder pack method produces a 100 μm thick diffusion chromized zone at 1100° C. in a 20% shorter time than with Armco iron. The good hardenability of the steel permits the cooling to be carried out in air and still get strength properties suitable for machine construction purposes, as can be seen from tables 4 and 5. Table 6 shows that the austenitising and water quenching plus tempering still improves the ductility of the steel.

These advantageous properties of the steel of the invention are due to the special alloying used and these properties exceed corresponding properties of previous steels. This alloying owes to (1) low carbon content to guarantee good toughness and fast diffusion chromizing, (2) alloying mainly with ferrite stabilizing elements which increases the growth rate of the chromized zone, and (3) use of strong carbide formers to prevent the formation of chromium carbides which decrease the growth rate of the diffusion zone, and to prevent the grain growth during the long chromizing heating.

I claim:

1. A process for making high strength steel having a chrome diffusion zone extending from its surface comprising the steps of:

(a) providing a low carbon content steel consisting essentially of the following composition (weight percent):

carbon: 0.01 to 0.08%
silicon: 0.1 to 1.0%
manganese: 0.5 to 2.2%
chromium: from more than 2.0 to 10%
molybdenum: 0.01 to 0.4%
aluminum: 0.002 to 0.05%
carbide former: up to 1%
iron: balance including normal impurities; and (b) subjecting said low carbon content steel to a chromium containing environment for a time and at an elevated temperature sufficient to diffuse chromium atoms into the surface of said low carbon steel and forming a diffusion zone or layer in said steel surface which is richer in chromium when compared against the rest of said steel.

2. The product made in accordance with claim 1 having a surface chrome concentration of about 40% or more.

3. The process according to claim 1 wherein said diffusion time for producing a 100 μm thick chromized layer is less than about 5 hours.

4. The process according to claim 3 wherein said diffusion layer comprises a chromium content in excess of 12%.

5. The process according to claim 4 wherein said diffusion temperature ranges from 900° C. to 1200° C.

6. The process according to claim 5 wherein said diffused steel is quenched in water from its diffusion temperature.

7. The chromized steel produced in accordance with claim 5.

8. The product made in accordance with claim 3, having a surface chrome concentration of about 40% or more.

9. In a process for making high strength carbon steel having a chrome diffusion zone extending inwardly from its surface using a low carbon steel or in the carbon content is 0.08% or less and at least one carbide-forming element taken from the group consisting of titanium, zirconium, niobium and tantalum is provided in a total amount not exceeding 1.0%, the improvement comprising (a) alloying said low carbon steel with from more than 2.0% to 10% by weight chromium which functions as a ferrite stabilizing element to increase the growth rate of the chromized zone; and (b) subjecting said low carbon content chromium-containing steel to a chromium-containing environment for a time and at an elevated temperature sufficient to diffuse chromium atoms into the surface of said steel and forming a diffusion zone which extends from said steel surface inwardly, said diffusion zone being richer in chromium when compared against the rest of said steel.

* * * * *